US008303210B2

(12) United States Patent
Parkes et al.

(10) Patent No.: US 8,303,210 B2
(45) Date of Patent: Nov. 6, 2012

(54) METHOD FOR CONSTRUCTING ADJACENT CAST IN PLACE CONCRETE SLABS USING A TEMPLATE FOR POSITIONING POCKET FORMERS

(76) Inventors: Nigel Parkes, Atlanta, GA (US); Russell Boxall, Matthews, NC (US)

( * ) Notice: Subject to any disclaimer, the term of this patent is extended or adjusted under 35 U.S.C. 154(b) by 1013 days.

(21) Appl. No.: 11/539,723

(22) Filed: Oct. 9, 2006

(65) Prior Publication Data

US 2008/0083130 A1 Apr. 10, 2008

(51) Int. Cl.
*E01C 11/06* (2006.01)
*E01C 23/02* (2006.01)

(52) U.S. Cl. ..... 404/74; 249/9; 404/88

(58) Field of Classification Search ..... 249/90, 249/91, 93, 96, 177, 9; 404/88, 89, 74, 57, 404/61, 62, 63; 29/428
See application file for complete search history.

(56) References Cited

U.S. PATENT DOCUMENTS 1,956,046 A * 4/1934 Robertson ..... 249/9
2,210,356 A * 8/1940 Bauer ..... 404/48
2,412,489 A 12/1946 Bieg
2,489,851 A * 11/1949 Bean ..... 249/9
2,636,426 A * 4/1953 Heltzel et al. ..... 249/9
2,745,165 A * 5/1956 Lewis ..... 249/3
3,964,219 A * 6/1976 Hala ..... 249/93
4,412,407 A 11/1983 Melfi et al.
4,904,111 A * 2/1990 Weisbach ..... 404/48
5,419,057 A 5/1995 Jackson
5,934,821 A 8/1999 Shaw et al.
6,145,262 A 11/2000 Schrader et al.
6,354,760 B1 3/2002 Boxall et al.
6,502,359 B1 1/2003 Rambo

OTHER PUBLICATIONS

International Search Report for PCT/US 2007/080818, dated Mar. 4, 2008.
International Preliminary Report on Patentability and Written Opinion of the International Searching Authority for related Application No. PCT/US2007/080818, dated Apr. 15, 2009, 7 pages.

* cited by examiner

*Primary Examiner* — Michael Safavi
(74) *Attorney, Agent, or Firm* — Banner & Witcoff, Ltd.

(57) ABSTRACT

A template for positioning a pocket former wherein the template positions the pocket former at a fixed depth with respect to the top of concrete formwork. The template comprises a support and a body. The support positions the template; the body comprises a positioner for locating a pocket former. A spacer that connects to the support according to the desired depth of the pocket former can also be included. The template thus provides a reliable and efficient way of ensuring that a pocket former is placed at the appropriate depth.

7 Claims, 4 Drawing Sheets

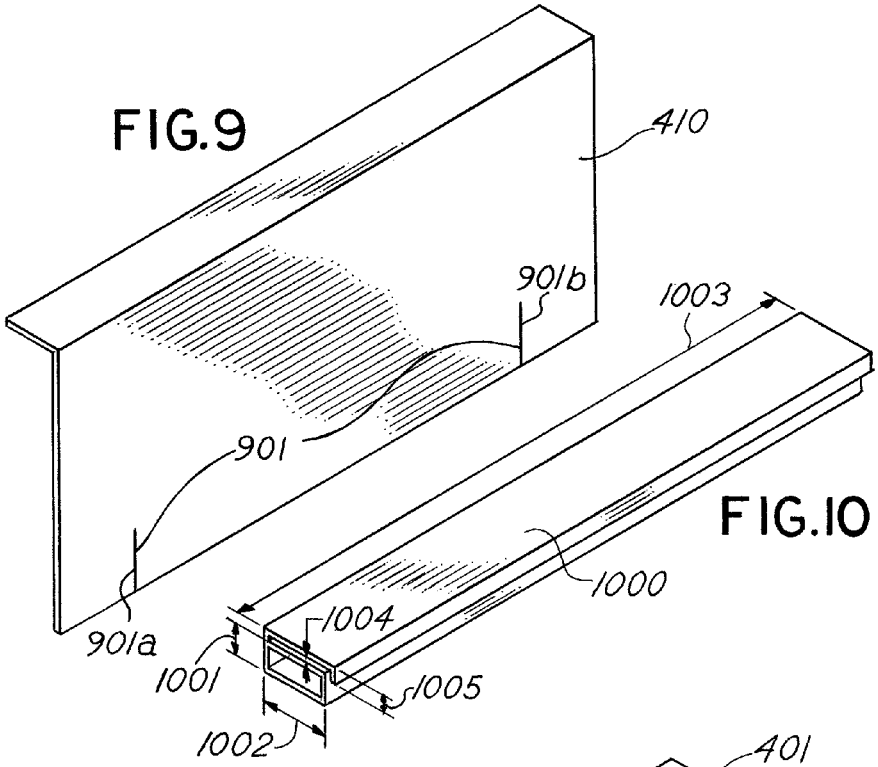
FIG.9
FIG.10
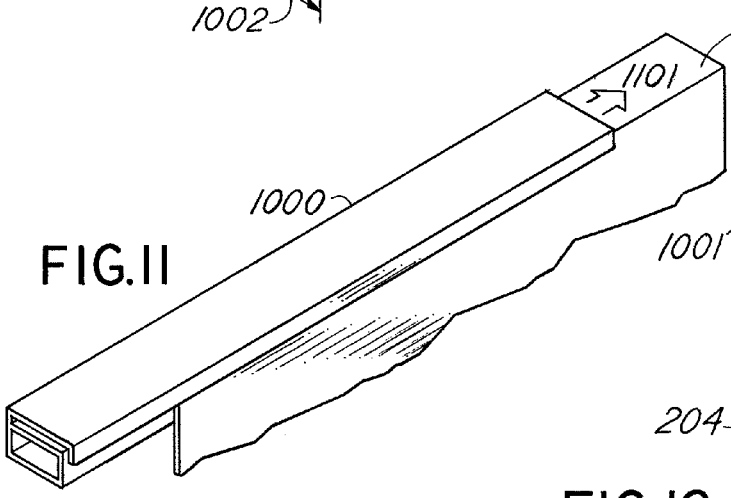
FIG.11
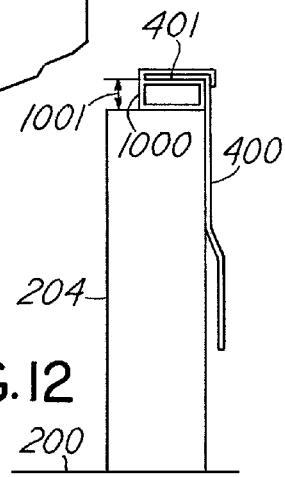
FIG.12

METHOD FOR CONSTRUCTING ADJACENT CAST IN PLACE CONCRETE SLABS USING A TEMPLATE FOR POSITIONING POCKET FORMERS

BACKGROUND OF THE INVENTION

1. Field of the Invention

This invention relates generally to a template for positioning a pocket former. More particularly, the invention relates to a template for positioning a pocket former wherein the template positions the pocket former at a fixed depth with respect to the top of concrete formwork.

2. Related Art

For logistical and technical reasons, concrete floor slabs are made up of a series of individual blocks. FIG. 1 shows a concrete floor 100 made up of a series of individual blocks or slabs 110*a* through 101*f* (collectively 101). The same is true for sidewalks, driveways, roads, and the like. The interface where one slab meets another is termed a joint. FIG. 1 further shows joints 102*a* through 102*g* (collectively 102). When the concrete is poured, it is typically poured one slab at a time. To form the concrete before it hardens, wooden boards are often used, typically called formwork or edge forms. FIG. 2 shows an edge form 204.

U.S. Pat. No. 6,354,760 ("the '760 patent") issued to Boxall et al., which is incorporated herein by reference, sets forth reasons why dowels are typically used to transfer loads between slabs 101. One type of dowel used to transfer loads between slabs 101 is a plate dowel. As disclosed in the '760 patent, a plate dowel is a plate that is relatively wide compared to its thickness or height and has a length to width ratio close to 1:1. A plate dowel often transfers the load to an adjacent slab by being mated with a pocket former. FIG. 3 hereof illustrates one example of how a plate dowel 300 is mated with a pocket former 301. Several ways exist to connect the pocket former 301 to the side of an edge form, including nails 302*a*, 302*b*.

To place a pocket former 301 at the appropriate depth in a slab 101 is currently an imprecise and time consuming task. The present invention simplifies the placement of a pocket former by ensuring the pocket former is placed at the appropriate depth with respect to edge form 204. The present invention further simplifies the placement of a pocket former by increasing the efficiency of placing a pocket former.

SUMMARY OF THE INVENTION

Aspects of the invention permit a template for positioning a pocket former to be efficiently and accurately placed on the side of an edge form. The template comprises a support and a body. The support operates to position the template. In one embodiment, the support is one piece and rests on the edge form. In another embodiment, the support is one piece and further comprises a member that extends downwardly on the side of the edge form opposite the body. In yet another embodiment, the support is more than one piece and these pieces have members that extend downwardly on the side of the edge form opposite the body. The body includes a positioner for locating the pocket former. In one embodiment, the positioner is within the body and has a rectangular cross-section. In another embodiment, the positioner is open on one side. In yet another embodiment, the positioner consists of guide marks.

Further aspects of the invention relate to a method for connecting the pocket former to the side of an edge form. In one example, the edge form is placed, the position of the load plate is determined, the appropriate template (and spacer) is selected, the template is located on the edge form, the pocket former is positioned, the pocket former is connected to the edge form, the template is removed, and the template is used again if desired.

These and other advantages will become apparent from the following detailed description when taken in conjunction with the drawings. A more complete understanding of the present invention and the advantages thereof may be acquired by referring to the following description in consideration of the accompanying drawings, in which like reference numbers indicate like features. The invention is being described in terms of exemplary embodiments. Numerous other embodiments, modifications, and variations within the scope and spirit of the appended claims will occur to persons of ordinary skill in the art from a review of this disclosure.

BRIEF DESCRIPTION OF THE DRAWINGS

FIG. 9 is an isometric view of yet another embodiment of the template wherein the positioner for locating the template is comprised of two guide marks.

FIG. 10 is an isometric view of one embodiment of a spacer that can be used to position the template such that the pocket former is positioned at the desired depth.

FIG. 11 an isometric view illustrating the spacer connecting to the support.

FIG. 12 is a side view of the spacer connected to the template on an edge form.

DETAILED DESCRIPTION OF THE DRAWINGS

Figure 4:
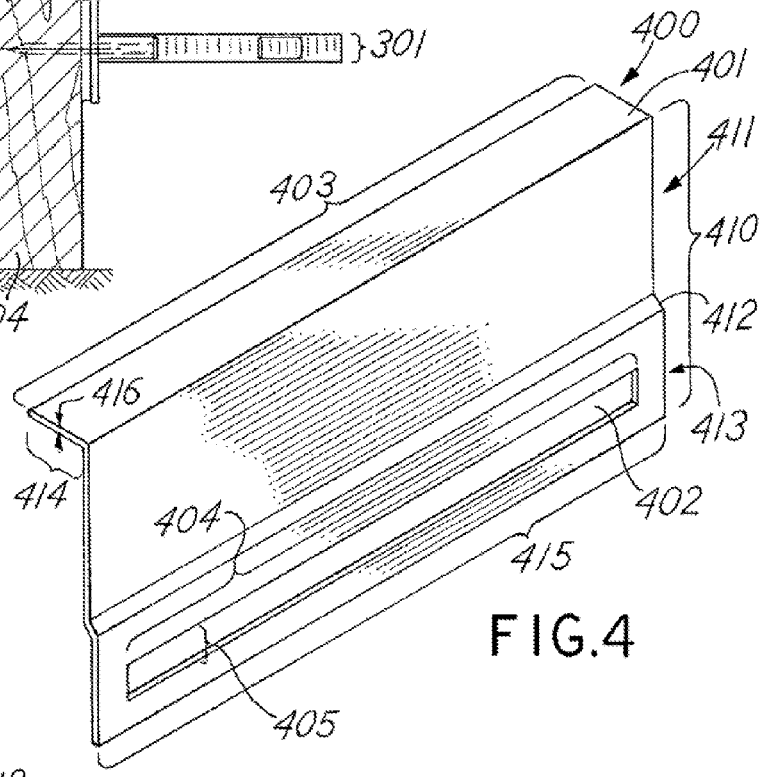
FIG. 4 is an isometric view of one embodiment of the template.
Figure 5:
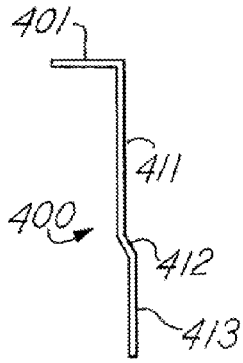
FIG. 5 is a side view of one embodiment of the template.

A design for a template for positioning a pocket former made in accordance with the claimed invention is shown in FIGS. 4, 5, 6, 7, 8, 9, 10, 11, and 12. FIGS. 4 and 5 show one embodiment of the template for positioning a pocket former. FIG. 4 is an isometric view while FIG. 5 is a side view. Referring to FIGS. 4 and 5, the template 400 includes a support 401 and a body 410. As used herein, the terms template for positioning a pocket former and template refer broadly to any structure that operates to position a pocket former.

Referring still to FIGS. 4 and 5, the support 401 has a length 403, a depth 414, and a thickness 416. The depth 414 can be any depth, but preferably not deeper than the thickness of the edge form 201 so as to help ensure that the body 410 fits flush against the formwork for positioning the pocket former. As those skilled in the art will recognize, one acceptable depth is that equal to the depth of a commonly used edge form, such as a "2×4" having a depth of approximately 1.5 inches. The length 403 can be any acceptable length to accommodate the pocket former. As those skilled in the art will further recognize, the length may be any suitable length up to the length 415 of the body 410. The thickness 416 can be any acceptable thickness.

Further referring to FIGS. 4 and 5, the body 410 is comprised of a lower body 413, a bend 412, and an upper body 411. The lower body 413 includes a positioner 402 for locating a pocket former. The positioner 402 is within the lower body 413 and has a rectangular cross-section with length 404 and height 405. The length 404 and height 405 can be any height necessary to accommodate a pocket former. The bend 412 projects away from the upper body 411 such that the lower body 413 is further from the side of the edge form than the upper body 411. The bend 412 thus allows the upper body 411 of the template to fit flush against the formwork when a pocket former is being positioned. The upper body 411 is the part of the body 410 between the support 401 and the bend 412.

Figure 6:
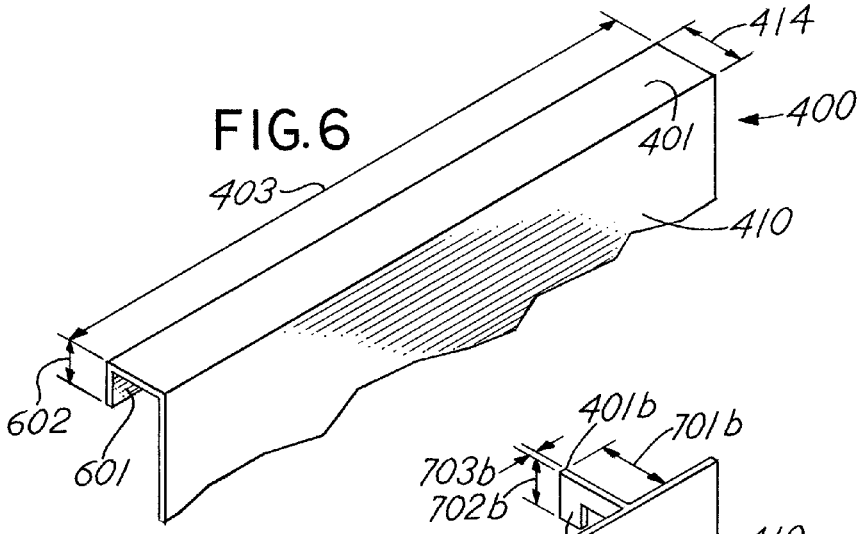
FIG. 6 is an isometric view of another embodiment of the template wherein the support extends downwardly on the side of the edge form opposite the body of the template.

FIGS. 4 and 5 show one embodiment of the invention but other embodiments are also within the scope of the claimed invention. FIG. 6 shows a second embodiment wherein the support fits over the formwork. Referring to FIG. 6, the support 401 has a length 403 and a depth 414. The support further comprises a member 601 that extends downwardly a height 602 on the side of the edge form opposite the body 410.

Figure 7:
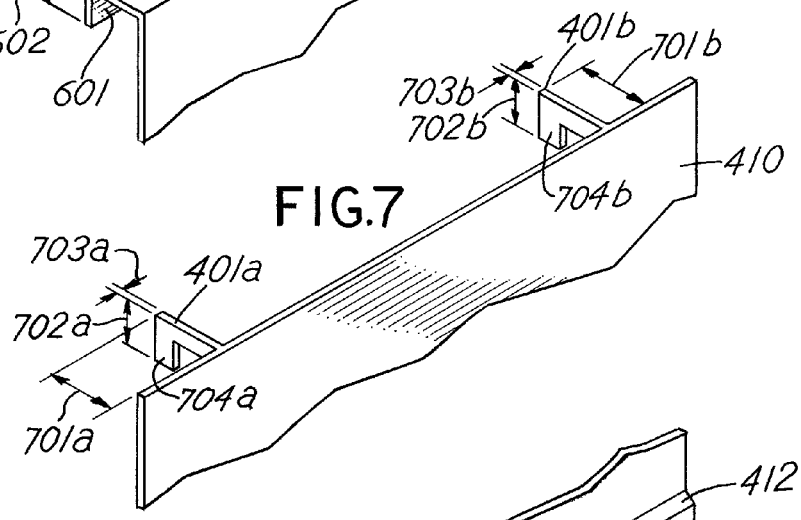
FIG. 7 is an isometric view of yet another embodiment of the template wherein the support is comprised of two pieces that extend downwardly on the side of the edge form opposite the body of the template.

Still another embodiment is shown in FIG. 7, wherein the support is comprised of two pieces, 401*a* and 401*b*. The two pieces 401*a* and 401*b* have a depth 701*a*, 701*b*, a thickness 703*a*, 703*b*, and members 704*a*, 704*b* that extend downwardly a height 702*a*, 702*b* on the side of the edge form opposite the body 410. The depths 701*a*, 701*b* can be any acceptable depth. As those skilled in the art will recognize, one acceptable depth is that equal to the depth of a commonly used edge form, such as a "2×4" having a depth of approximately 1.5 inches. The thickness 703*a*, 703*b* can be any acceptable thickness and the height 702*a*, 702*b* can be any acceptable height.

Figure 8:
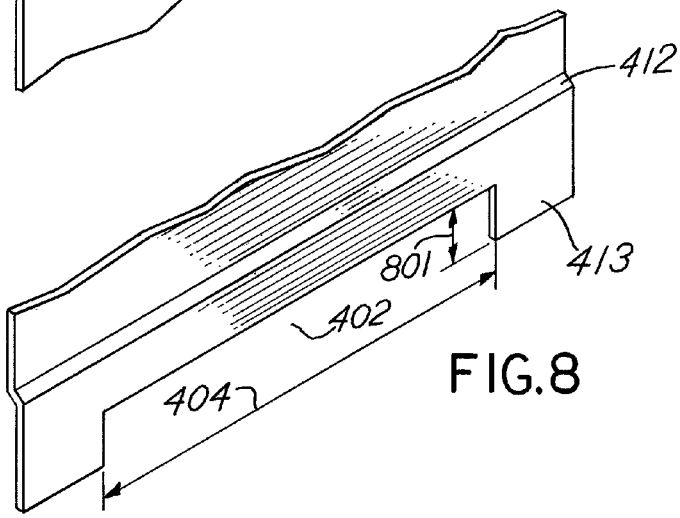
FIG. 8 is an isometric view of yet another embodiment of the template wherein the positioner for locating the pocket former is open on one side.

In another embodiment shown in FIG. 8, the lower body 413 contains a positioner 402 having a length 404 and a height 801 wherein the positioner 402 for locating the pocket former is open on one side. The length 404 and the height 801 can be any acceptable length and height necessary to accommodate a pocket former.

Finally, in the embodiment shown in FIG. 9, the body 410 does not contain an upper body, a bend, and a lower body but does contain a positioner 901. The positioner 901 is comprised of two guide marks, 901*a* and 901*b*.

Figure 1:
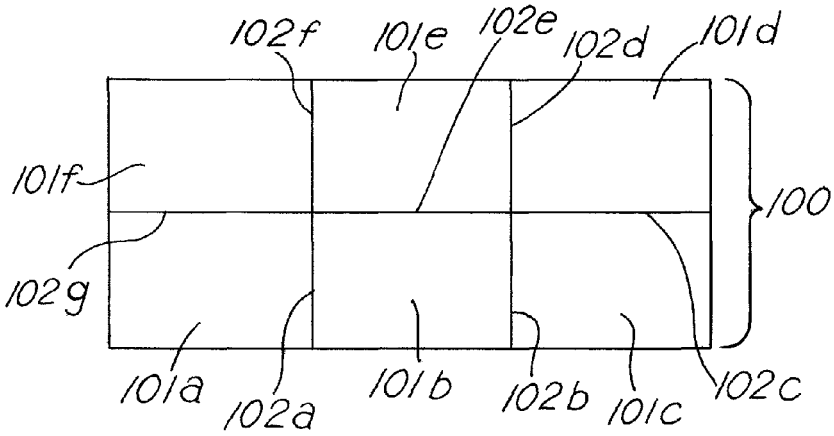
FIG. 1 is a top view of a concrete floor.
Figure 3:
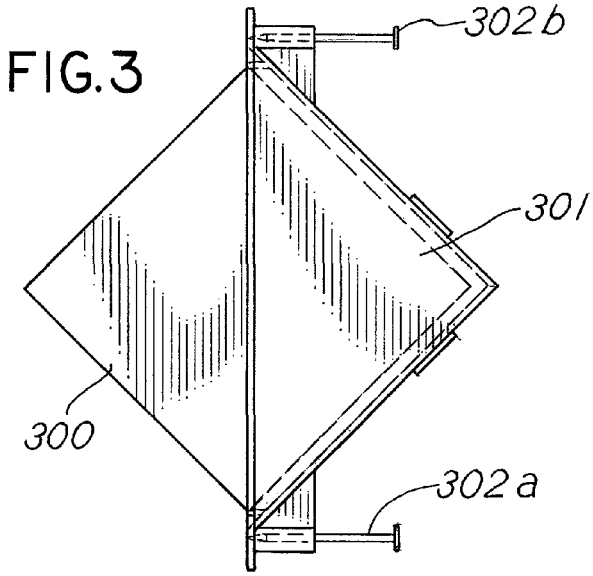
FIG. 3 is a top view of a plate dowel mated with a pocket former.
Figure 2:
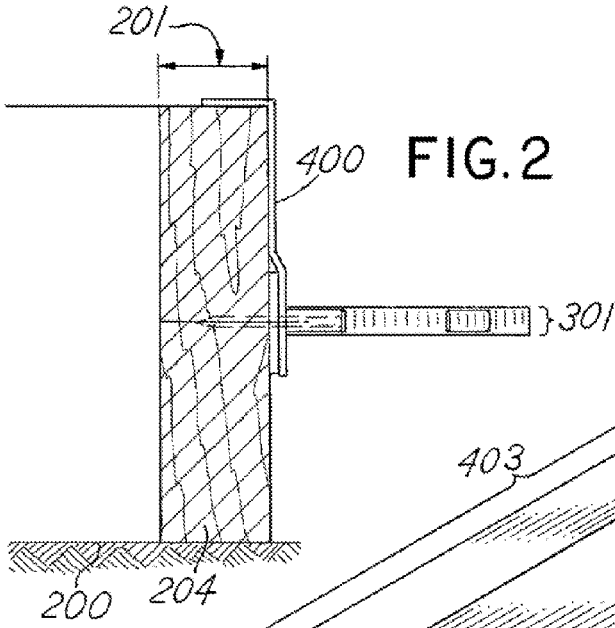
FIG. 2 is a side view of the template illustrating the pocket former connected to the side of an edge form.

FIG. 2 shows one embodiment of the template in use. The template 400 is placed on the edge form 204 which sits on the ground 200. The pocket former 301 is thus positioned at an acceptable depth with respect to the top of the formwork 204.

FIG. 10 is one embodiment of a spacer. A spacer is used to adjust the position of the template such that the pocket former is positioned at the desired depth. Referring to FIG. 10, the spacer 1000 has a height 1001, a depth 1002, and a length 1003. The height 1001 is determined by the desired depth of the pocket former. This depth can be any depth, but as those skilled in the art will recognize, one desired depth is that equal to the mid-depth of a concrete slab not shown) to be poured later. The length 1003 can be any length, but at those skilled in the art will further recognize, one acceptable length is that equal to the length 403 of the support 401. The depth 1002 can be any depth, but as those skilled in the art will further recognize, one acceptable depth is that equal to the depth 414 of the support 401. The dimension 1004 should be sufficient to accommodate the thickness 416 of the support 401. Further, the dimension 1005 should be sufficient to ensure the spacer remains in contact with the template 400.

FIG. 11 illustrates the spacer 1000 connecting to the support 401. The spacer 1000 slides onto the support 401 as depicted by the arrow 1101.

FIG. 12 illustrates the spacer 1000 in use. The spacer 1000 is connected to the support 401 and placed on the edge form 204. The edge form 204 sits on the ground 200. As a result of the spacer 1000 being used, the template 400 is raised by the height 1001 of the spacer 1000.

While in the foregoing, there have been described various preferred embodiments of the present invention, it should be understood to those skilled in the art that various modifications and changes can be made without departing from the scope of the invention as recited in the claims. An effort has been made to prepare claims commensurate in scope with this description without any failure to claim any described embodiment and within the best abilities of the claimed inventors to foresee any modifications or changes.

We claim:

1. In a method for constructing adjacent cast in place, first and second poured concrete slabs on a the ground, said poured concrete slabs each having an upper surface, a lower surface, and an upright edge formed between said upper and lower surfaces, said method including the steps of providing and securely positioning formwork on said the ground before pouring either of said poured concrete slabs, said formwork having an upright side for later forming said upright edge of said first concrete slab and a top for potential use in forming said upper surface of said first concrete slab, providing at least one load plate pocket former to be positioned in said first poured concrete slab at said upright edge of said first concrete slab, providing at least one load plate with first and second portions, and positioning said first portion of said load plate within said load plate pocket former within said first concrete slab, the improvement comprising the steps of:

a) providing a reusable template comprising a support that in use while positioning the load plate pocket former and before either poured concrete slab is poured may be rested above the top of the formwork and a body that includes a positioner for locating the load plate pocket former at a first preselected position on the side of said formwork and at a preselected depth relative to said top of said formwork and relative to said template support while said template is in said use and rested above the top of the formwork;

b) using the template before pouring said poured concrete slabs by manually, temporarily resting the support above the top of the formwork, and using the positioner, manually, temporarily locating said load plate pocket former on said side of said formwork while extending said load plate pocket former into the area where said load plate pocket former is later embedded in said subsequently poured upright edge of said first concrete slab;

c) removing said reusable template from said formwork and said area where said load plate pocket former is later embedded in said subsequently poured upright edge of said first concrete slab, before pouring said poured concrete slabs, while maintaining the positioning of said load plate pocket former on said side of said formwork, for potential further use of said reusable template; and d) pouring concrete to form said first concrete slab and to embed said load plate pocket former in said first concrete slab while said template is removed from said formwork and said area where said load plate pocket former is being embedded, such that upon completion of said pouring said load plate pocket former is embedded in said first concrete slab and is positioned to later receive said first portion of said load plate while said second portion of said load plate is positioned in the area where said second concrete slab is to be later poured to embed said second portion of said load plate in said second poured concrete slab and said template remains available for potential further use in repetition of the method to pour additional slabs.

2. The improvement of claim 1 including using the template and through its use repeating steps a), b), and c) at least one time with a load plate pocket former and load plate which are in addition to the load plate pocket former and load plate referenced in claim 1 and doing so at at least one preselected position which is in addition to the preselected position referenced in claim 1, before performing step d) of pouring said concrete to form said first concrete slab thereby embedding multiple pocket formers in said first concrete slab and reusing said template.

3. The improvement of claim 2 including the step of laterally advancing said reusable template to additional preselected positions on said formwork before uses of the template and through said uses repetition of steps a), b) and c).

4. The improvement of claim 2 of inserting first portions of multiples of said load plates into multiples of said load plate pocket formers while said multiples of said pocket formers are embedded in said first concrete slab while extending said second portions of said load plates into the area where concrete is to be subsequently poured to form said second concrete slab, and pouring concrete to form said second concrete slab for embedding said second portions of said load plates in said second concrete slab.

5. The improvement of claim 4 including the steps of lateralling advancing said reusable template to multiple preselected positions on said formwork.

6. The improvement of claim 1 including the further steps of:

inserting said first portion of said load plate into said load plate pocket former while said load plate pocket former is embedded in said first concrete slab and extending said second portion of said load plate into the area where concrete is to be subsequently poured to form said second concrete slab; and pouring concrete to form said second concrete slab for embedding at least second portion of said load plate in said second concrete slab.

7. The improvement of claim 1 including the further step of removing said formwork from said ground after pouring said first concrete slab for enabling the positioning said first portion of said load plate in said embedded pocket former.

* * * * *